US009181736B1

(12) United States Patent
Luca

(10) Patent No.: US 9,181,736 B1
(45) Date of Patent: Nov. 10, 2015

(54) COMPACT DOOR CLOSING LATCHING MECHANISM

(71) Applicant: Valentin Luca, Fairfield, CT (US)

(72) Inventor: Valentin Luca, Fairfield, CT (US)

( * ) Notice: Subject to any disclaimer, the term of this patent is extended or adjusted under 35 U.S.C. 154(b) by 43 days.

(21) Appl. No.: 13/673,023

(22) Filed: Nov. 9, 2012

Related U.S. Application Data

(60) Provisional application No. 61/560,349, filed on Nov. 16, 2011.

(51) Int. Cl.

| | |
|---|---|
| ***E05C 1/06*** | (2006.01) |
| ***E05C 1/12*** | (2006.01) |
| ***E05B 63/20*** | (2006.01) |
| ***E05B 17/00*** | (2006.01) |
| *E05F 1/00* | (2006.01) |

(52) U.S. Cl.
CPC ..... *E05C 1/12* (2013.01); *E05B 17/0025* (2013.01); *E05B 63/20* (2013.01); *E05B 63/202* (2013.01); *E05F 1/00* (2013.01); *E05F 1/002* (2013.01)

(58) Field of Classification Search
CPC ... E05B 17/0025; E05B 63/202; E05B 63/20; E05F 1/00; E05F 1/002; E05C 1/12
USPC ..... 292/1.5, DIG. 60, 19, 137, 138, 140, 292/143, 163, 169, 173, 150, 347; 70/107–111, 150, DIG. 6, 142, 151 R
See application file for complete search history.

(56) References Cited

U.S. PATENT DOCUMENTS

| | | | | |
|---|---|---|---|---|
| 671,792 | A * | 4/1901 | Comber | 292/2 |
| 3,322,451 | A * | 5/1967 | Bredemus | 292/137 |
| 4,572,556 | A | 2/1986 | Foshee | 292/165 |
| 4,890,870 | A * | 1/1990 | Miron | 292/333 |
| 5,560,079 | A * | 10/1996 | Jeynes | 16/80 |
| 5,820,177 | A * | 10/1998 | Moon | 292/335 |
| 6,327,881 | B1 * | 12/2001 | Grundler et al. | 70/107 |
| 6,536,245 | B2 * | 3/2003 | Chiang | 70/107 |
| 6,578,888 | B1 * | 6/2003 | Fayngersh et al. | 292/332 |
| 6,651,466 | B1 | 11/2003 | Shih | 70/107 |
| 6,851,287 | B1 | 2/2005 | Yang et al. | 70/107 |
| 7,007,985 | B2 * | 3/2006 | Alexander et al. | 292/163 |
| 8,051,534 | B1 | 11/2011 | Luca | 16/667 |
| 2002/0101083 | A1 * | 8/2002 | Toledano et al. | 292/332 |
| 2005/0092040 | A1 * | 5/2005 | Chuang | 70/107 |
| 2006/0123859 | A1 * | 6/2006 | Gonzalez | 70/107 |
| 2009/0033107 | A1 * | 2/2009 | Zimmer et al. | 292/302 |
| 2009/0151407 | A1 * | 6/2009 | Lin | 70/107 |

* cited by examiner

*Primary Examiner* — Vishal Patel
*Assistant Examiner* — Christine M Mills
(74) *Attorney, Agent, or Firm* — Fattibene and Fattibene LLC; Paul A. Fattibene

(57) ABSTRACT

A door mechanism pulling a door closed for latching. A puller tongue is triggered to release when adjacent a strike plate or jamb of a door. The puller tongue pushes the door completely closed resulting in latching. A setting lever is rotated upon turning a door knob setting the puller tongue in a retracted position. A raising lever and pendulum selectively cause the releasing of the puller tongue when the latch contacts a strike plate or jamb of a door and prevents releasing of the puller tongue when a door knob is turned. A door is caused to securely latch even though the door is closing slowly and with little force.

19 Claims, 11 Drawing Sheets

COMPACT DOOR CLOSING LATCHING MECHANISM

RELATED APPLICATION

This application claims the benefit of U.S. Provisional Application No. 61/560,349 filed Nov. 16, 2011.

FIELD OF THE INVENTION

The present invention relates in general to a door closing mechanism and more particularly to a compact mechanism for assisting the complete closure and latching of a door.

BACKGROUND OF THE INVENTION

Pneumatic door closers often may not be adjusted properly to cause a door to close and latch completely. Often the door may close lightly with the latch resting on a strike plate or the jamb.

There are pneumatic door closers that are intended to provide improved door closing. One such pneumatic door closer is disclosed in U.S. Pat. No. 8,051,534 entitled "Pneumatic Door Closer" and issuing to Valentine Luca on Nov. 8, 2011. Therein disclosed is a pneumatic door closer that provides a controlled rate of closing motion that is generally uniform, smooth, and safe in moving from an open to closed position. While these and other pneumatic door closers have improved the closing of a door, often the door does not completely close and latch. This may be due to inappropriate adjustment of the pneumatic mechanism or temperature changes that affect the pneumatic mechanism.

Therefore, there is a need for a mechanism to assure that the door is latched when closed. There is an additional need for a mechanism that is compact such that it could be fitted inside and made part of a conventional door latch.

SUMMARY OF THE INVENTION

The present invention provides a door closing latching mechanism that mechanically closes and latches a door. A latch is mechanically coupled to a puller tongue. When the latch contacts the edge of the door fame or a strike plate the latch is displaced inward releasing the puller tongue. When the puller tongue is released the puller tongue forces the door to move causing the latch to securely latch the door closed.

A setting lever coupled to a door handle receiver rotates setting the puller tongue in a retracted position to be released. A pendulum coupled to the latch moves a trigger lever when in the latch is moved inward releasing the puller tongue so that the door latches. A rising lever disengages the latch from the pendulum when a door handle is turned to open the door.

An adjustment is provided for adjusting the location or point of release of the puller tongue and force required for release of the puller tongue. In one embodiment a trigger adjusting screw is used to adjust the triggering mechanism for releasing the puller tongue. In another embodiment a trigger force amplifier mechanism is use to adjust the force required to release the puller tongue.

It is an object of the present invention to prevent doors from being left partially open.

It is another object of the present invention to automatically assist a door to latch closed.

It is an advantage of the present invention that it is easily fitted into existing doors.

It is another advantage of the present invention that the location or timing of the door latching is easily adjustable.

It is yet another advantage of the present invention that the latching trigger force is adjustable.

Is a feature of the present invention that a puller tongue is used to secure latching of a door.

It is another feature of the present invention that a trigger adjusting screw is used to adjust the trigger point or location.

Is yet another feature of the present invention that in one embodiment the trigger force may be adjusted or amplified with a lever.

These and other objects, advantages, and features will become more readily apparent in view of the following detailed ascription.

BRIEF DESCRIPTION OF THE PREFERRED EMBODIMENTS

FIGS. 1-4B illustrate a first embodiment of the present invention. In this embodiment a door closing latching mechanism is disclosed which provides a means by which a door may be securely closed and latched even if the door is closed too slowly so that the latch of the door only rests on a strike plate or jamb or when there is insufficient initial closing force to completely close and latch the door.

Figure 2A:
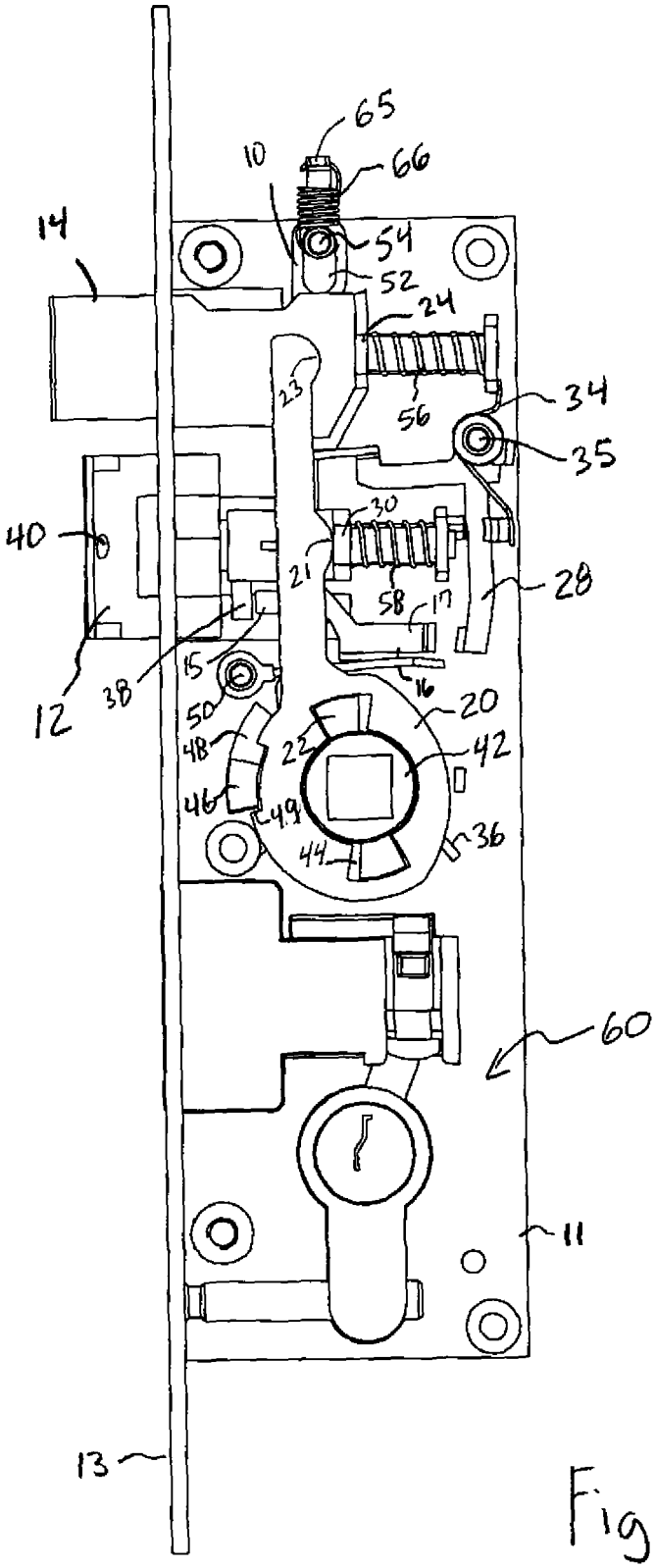
FIGS. 2A-2C are elevational views schematically illustrating the closing latching mechanism of the present invention in a sequence of operation.
Figure 2B:
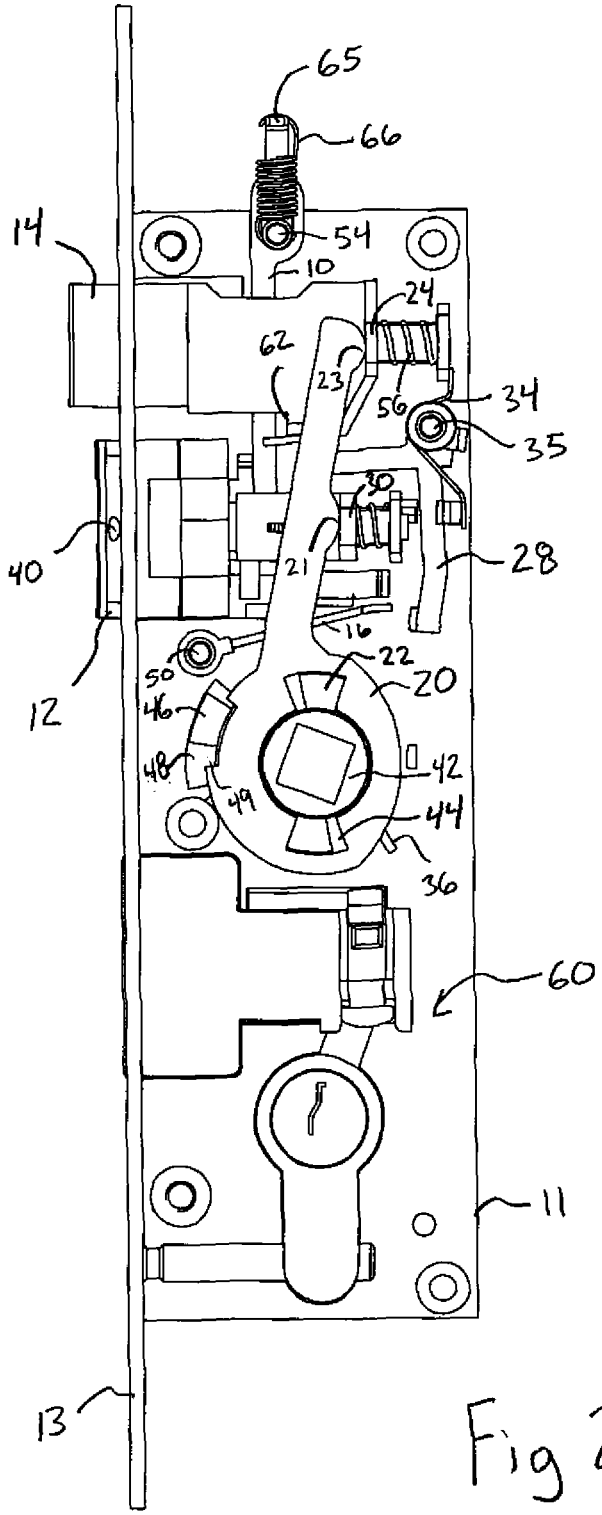
Figure 2C:
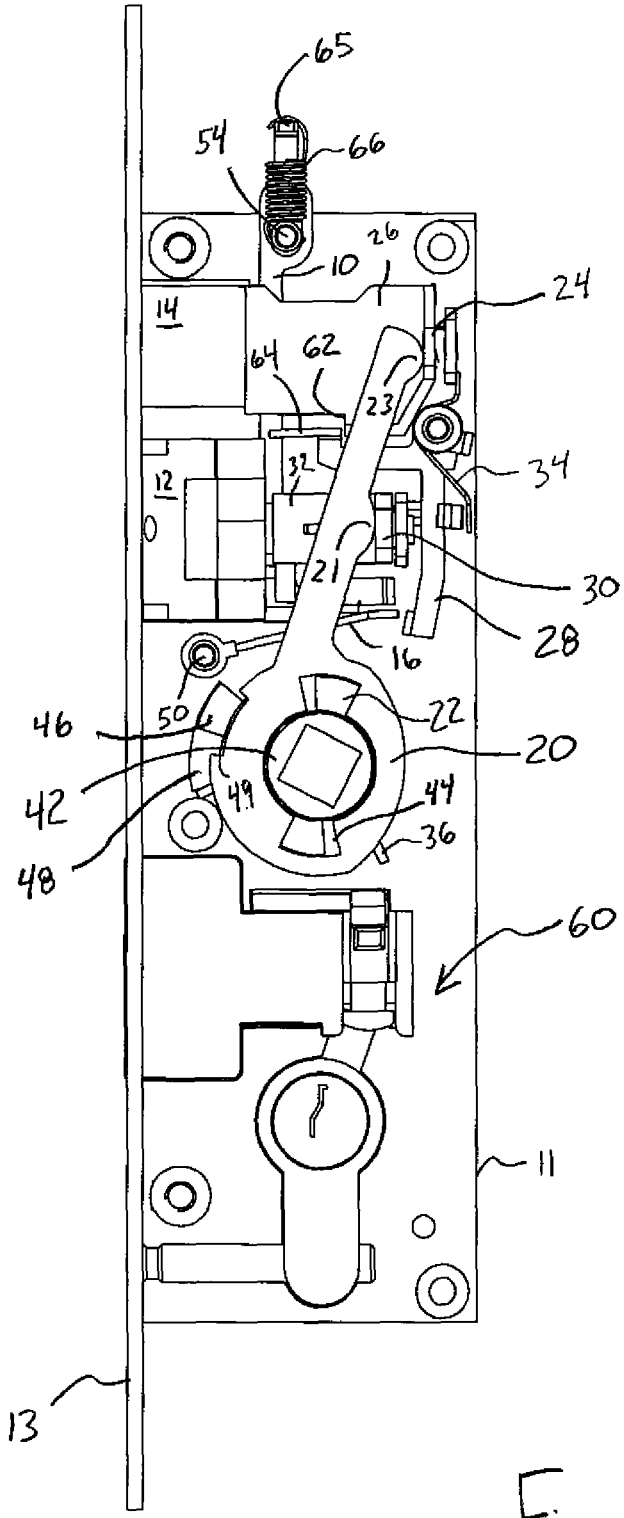

FIGS. 2A-2C illustrate the operation of the door closing latching mechanism of the present invention viewed from one side during turning of a door knob and the setting of the mechanism to a state for facilitating secure door closing and latching.

Figure 3A:
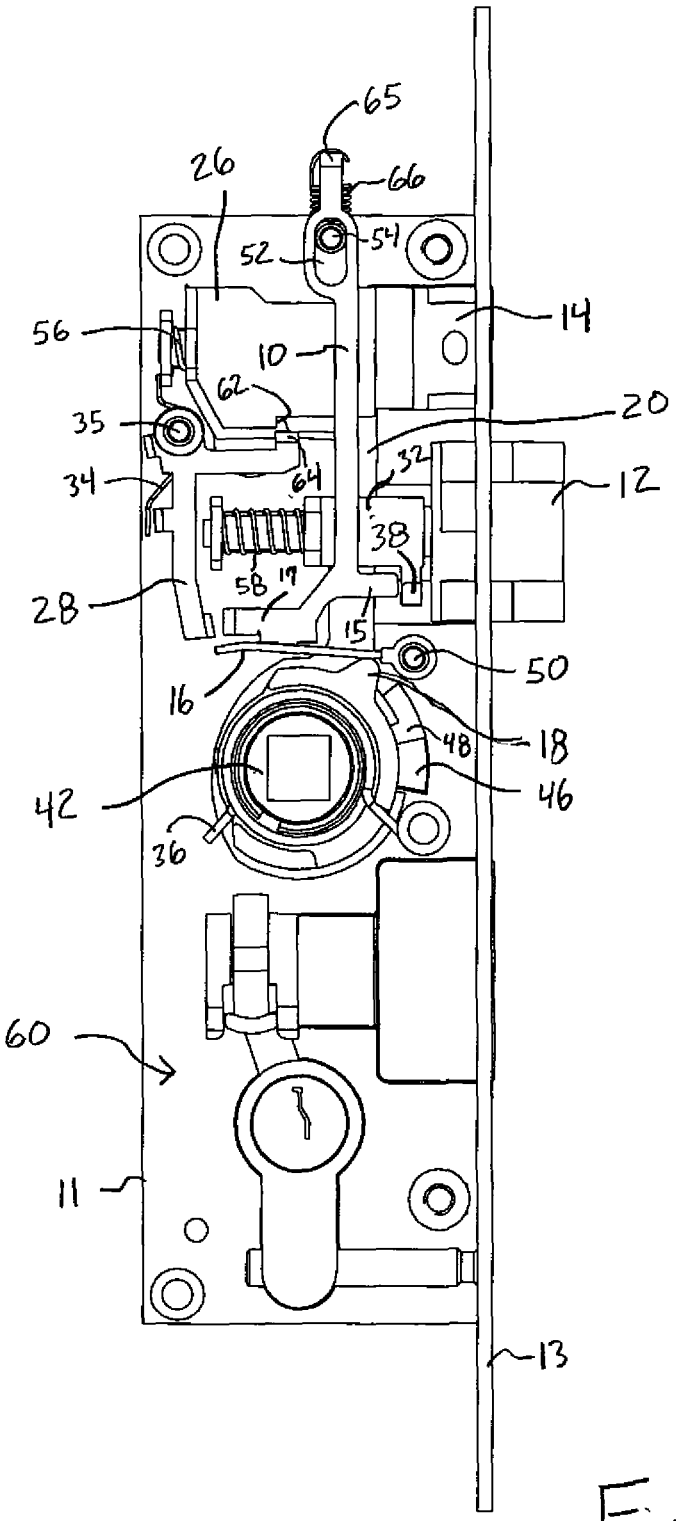
FIGS. 3A-3B are rear elevational views schematically illustrates the closing latching mechanism of the present invention in a sequence of operation.
Figure 3B:
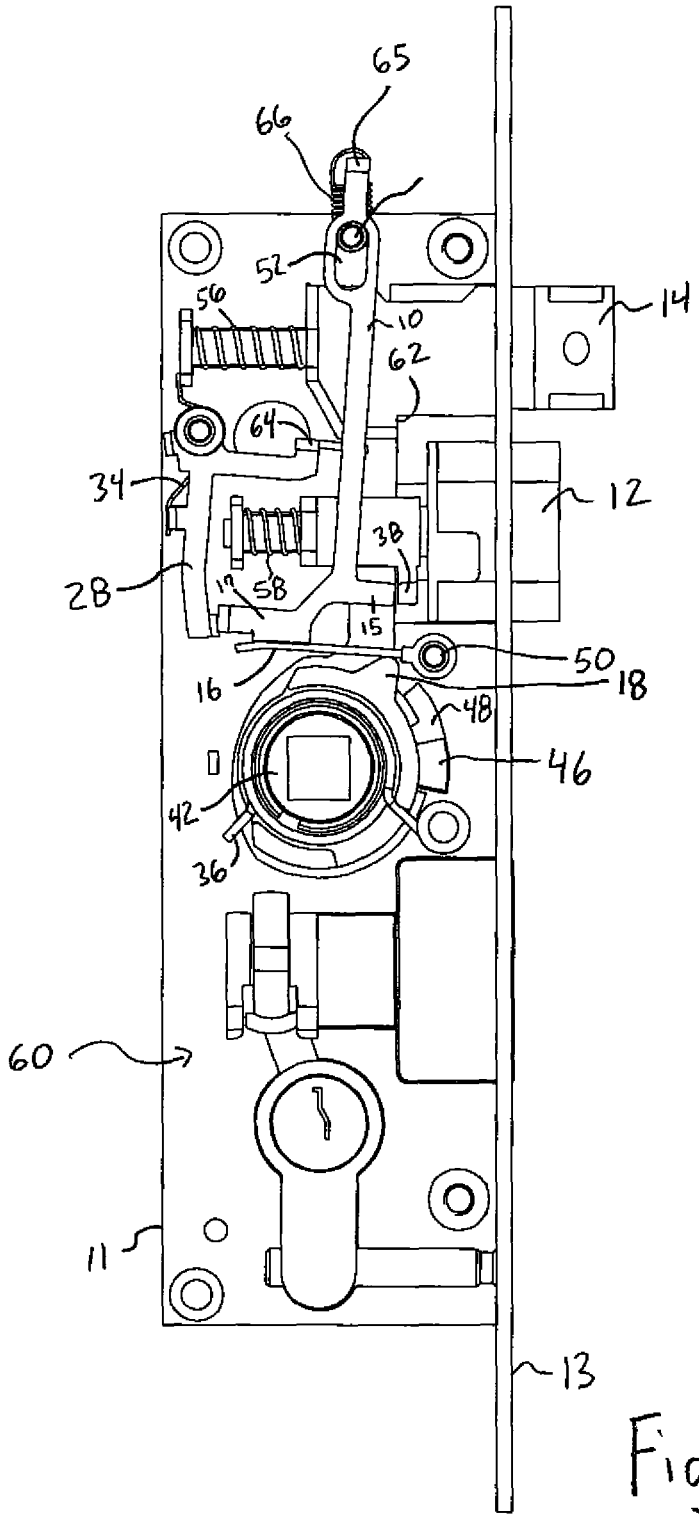

FIGS. 3A-3B illustrate the operation of the door closing latching mechanism of the present invention viewed from the other side during the release of the mechanism for facilitating secure door closing and latching.

Figure 4A:
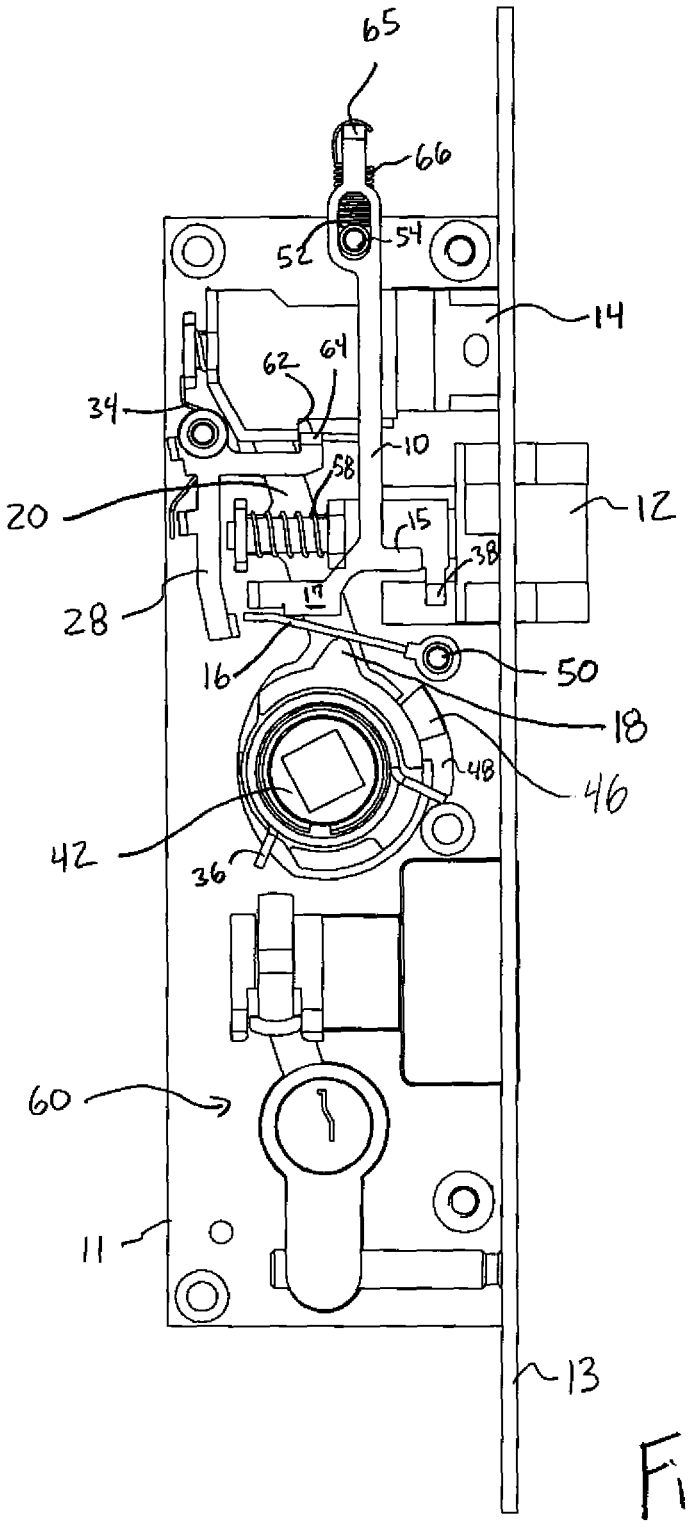
FIGS. 4A-4B are rear elevational views schematically illustrates the latching mechanism of the present invention in a sequence of operation.
Figure 4B:
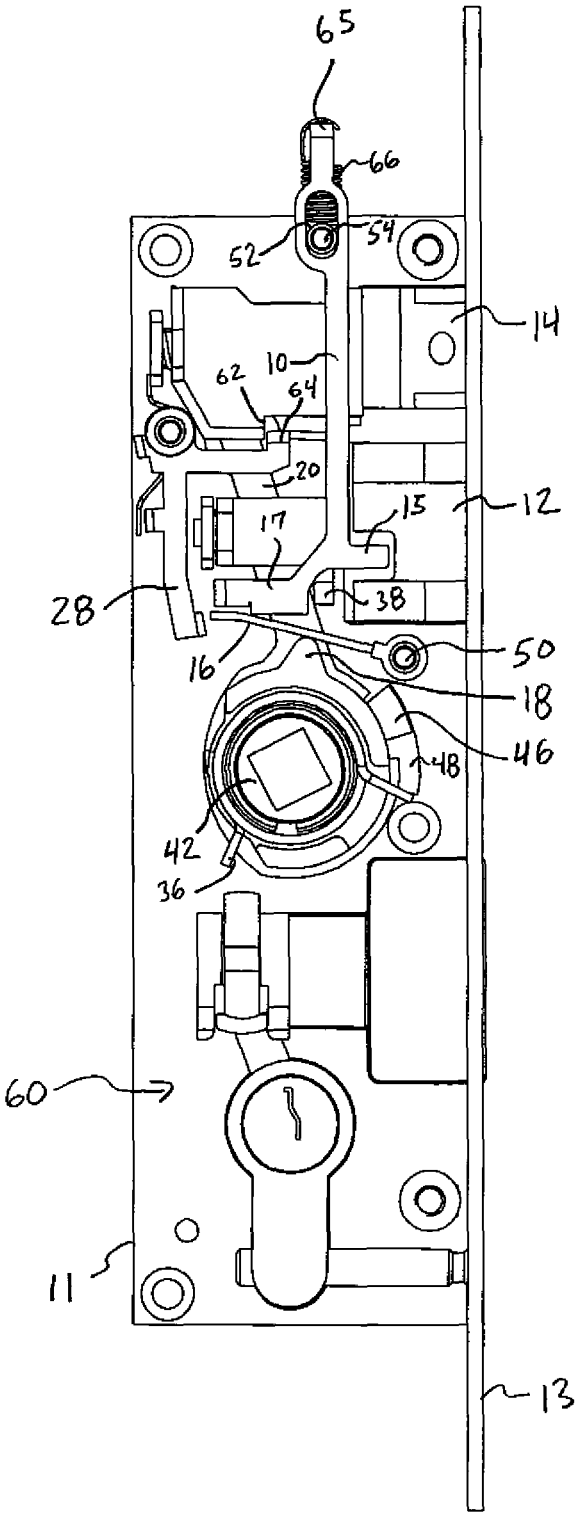

FIGS. 4A-4B illustrate the operation of the door closing latching mechanism viewed from the same side as illustrated in FIGS. 3A-3B and illustrate turning of a door knob, not shown, coupled to the door handle receiver setting the mechanism and retracting the latch 12 and opening a door without triggering the puller tongue 14.

Figure 1:
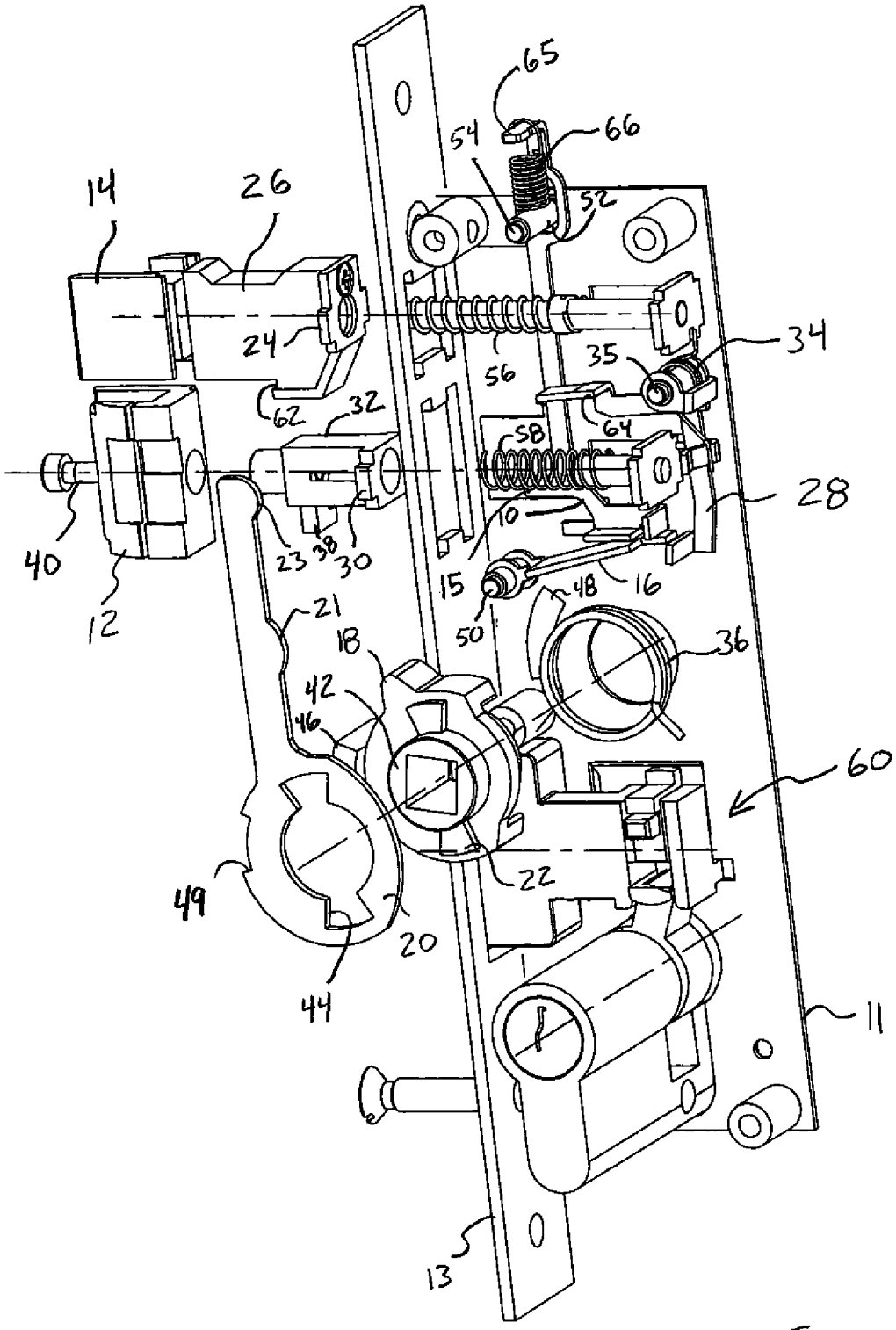
FIG. 1 is an exploded perspective view schematically illustrating the closing latching mechanism of the present invention.

Referring to FIGS. 1-4B the structure and operation of the present invention in this first embodiment can readily be appreciated. In FIG. 1 the assembly and operation of the present invention can readily be appreciated. The elements or parts of the compact door closing latch mechanism are mounted on a frame 11. Mounted on the frame 11 is a pendulum 10 as well as a latch 12 and a puller tongue 14. Also mounted on the frame 11 is a setting lever 20 coupled to a door handle receiver 42 by protruding lugs 22 held in lug slots 44. Setting lever 20 also has a tab notch 49. A tab 46 moves within tab opening 48. A setting lever spring 36 biases the setting lever 20 counter clockwise. As a door knob, not illustrated, attached to the door handle receiver is turned, the raising lever 16 pivots on raising lever pivot 50 and contacts the pendulum 10 which pivots on pendulum pivot 54 and raises in pendulum slot 52. The pendulum 10 may be biased downward by pendulum spring 66 held on pendulum spring arm 65.

The puller tongue 14 is attached to puller tongue extension 26. The puller tongue extension 26 has a puller tongue contact 24 thereon. The puller tongue 14 is biased outward by puller tongue spring 56. A trigger latch catch 64 slides on a surface of the puller tongue extension 26 as the puller tongue extension retracts into the frame 11 due to being pushed by setting lever 20. The trigger latch catch 64 is on one arm of trigger lever 28 that pivots on trigger lever pivot 35 and may be biased in a clockwise direction by trigger lever spring 34. The other arm of trigger lever 28 has a trigger lever arm that contacts trigger arm 17 of pendulum 10. The latch 12 is coupled by trigger adjustable screw 40 to a latch extension 32. Latch 12 is biased outward by latch spring 58. The trigger adjustable screw 40 can move the latch 12 in and out relative to the latch extension 32 thereby adjusting the point or location at which the mechanism is triggered releasing the puller tongue 14. Placed on the latch extension 32 are a pendulum contact 38 and a latch contact 30.

A cam or lobe 18 is formed on the door handle receiver 42 and is placed behind the setting lever 20. The apex of the cam or lobe 18 is placed adjacent the raising lever 16. A dead bolt 60 may be provided with the mechanism and operates independently of the compact door closing latch mechanism of the present invention.

The operation of the present invention in setting of the puller tongue 14 in a position for drawing a door closed can readily be appreciated with reference to FIGS. 2A-4B. In FIG. 2A the compact door closing latch mechanism is in a position ready to be set by the turning of a door knob, not illustrated, attached to door handle receiver 42. As the door handle receiver 42 is turned, the interaction of the lugs 22 with the lug slots 44 begins to rotate the setting lever 20 clockwise against the bias of the setting lever spring 36. As the door handle receiver 42 continues to rotate clockwise, the setting lever 20 has an intermediate contact 21 contacting latch contact 30 and a distal end contact 23 contacting puller tongue contact 24. This pushes the latch 12 and the puller tongue 14 into the frame 11 causing both to retract into the frame 11. At the same time the cam or lobe 18 rides on the surface of the raising lever 16 pushing it and the pendulum 10 upward along a radius of the arc of the pendulum 10 with pendulum slot 52 moving relative to pendulum pivot 54. This disengages or renders misaligned trigger arm 17 of the pendulum 10 decoupling the latch 12 from the trigger lever 28.

FIG. 2B illustrates setting lever 20 and intermediate contact 21 pushing the latch contact 30 and the distal end contact 23 pushing the puller tongue contact 24 and the puller tongue 14 into the frame 11.

As seen in FIG. 2C, when the door handle receiver 42 is rotated clockwise so that the tab 46 is restrained by the tab opening 48 from further rotation, the latch 12 and puller tongue 14 are completely retracted within the frame 11 and the trigger lever 28, which is biased in a clockwise direction by spring 34, causing the trigger latch catch 64 to engage the tongue extension shoulder 62. Accordingly, the puller tongue 14 is held in a retracted position against the bias of puller tongue spring 56, illustrated in FIG. 2B. The puller tongue 14 will remain retracted as long as the trigger lever catch 64 is engaged with the tongue extension shoulder 62. Accordingly, when the door handle receiver 42 is released, the lever 20 will rotate counterclockwise permitting the latch 12 to extend from the frame 11 with the puller tongue 14 being maintained retracted within the frame 11 by lever catch 64 engaging tongue extension shoulder 62. Once the puller tongue 14 is engaged by the trigger lever catch 64 a user's rotation of a handle doesn't release the puller tongue 14.

FIGS. 3A-3B illustrate the other side or rear of the door closing latch mechanism relative to FIGS. 2A-2C. In FIGS. 3A-3B the mechanism causing the holding and release of the puller tongue 14 is more clearly illustrated. FIG. 3A illustrates the door closing latch mechanism in a set position with the puller tongue held retracted within the frame 11. As a door closes and the latch 12 strikes a strike plate or jamb, not shown, with less force than required to completely latch the door, the latch 12 will be pushed some distance inward within the frame 11. As the latch 12 is pushed inward by the strike plate, jamb, or frame of the door, a pendulum contact 38 coupled to the latch extension 32 contacts latch arm 15 of the pendulum 10. The pendulum 10 is pushed to the left caused it to rotate clockwise and trigger arm 17 pushes against the trigger lever 28. The trigger lever 28 is caused to rotate clockwise against the bias of the trigger lever spring 34. This causes the other arm of the trigger lever 28 having the trigger lever catch 64 attached to be lowered or moved from tongue extension shoulder 62, releasing the puller tongue 14 causing it to extend from the frame 11.

As illustrated in FIG. 3B, the release of the shoulder 62 from the trigger lever catch 64 causes the puller tongue spring 56 to force the puller tongue 14 out of the frame 11. The angled surface on the puller tongue 14, being opposite to that of the latch 12, pushes or draws the door closed, permitting the latch 12 to securely engage a latch opening in a strike plate or door jamb, not shown. A puller tongue opening may be formed in the strike plate or jamb, not shown, to receive the puller tongue 14. Accordingly, the door is securely closed despite the door closing with less force than would be required to permit latch 12 to securely engage the latch opening in the strike plate or door jamb without the additional force provided by the puller tongue 14.

FIGS. 4A-4B illustrate the operation of the compact door closing latch mechanism of the present invention when a door knob is turned for opening the door and retracting the latch 12 with the puller tongue 14 remaining in a set or retracted position. When the door handle receiver 42 is rotated counterclockwise against the bias of the setting lever spring 36 the cam or lobe 18 causes the raising lever 16 to pivot upward and clockwise about raising lever pivot 50, pushing the trigger arm 17 and pendulum 10 upward. As the pendulum 10 is pushed upward, the latch arm 15 of the pendulum 10 disengages from the pendulum contact 38 and the trigger arm 17 of the pendulum 10 disengages from the trigger lever 28. The setting lever 20 rotates counterclockwise with the door handle receiver 42 and pushes the latch contact 30, as illustrated in FIGS. 2A-2C, on latch extension 32 of latch 12 so as to retract the latch 12 within the frame 11. As a result of a disengagement or misalignment of the trigger lever 28 with the trigger arm 17 of the pendulum 10, the trigger lever 28 is not caused to rotate as the latch 12 is retracted within the frame 11 as the door handle receiver 42 is rotated. Therefore, the trigger lever catch 64 does not disengage the tongue extension shoulder 62 resulting in the puller tongue 14 being securely retained within the frame 11.

FIG. 4B illustrates the latch 12 being fully retracted within the frame 11. The door is opened by retracting latch 12 and with the puller tongue 14 remaining retracted within the frame 11. The trigger adjustable screw 40, illustrated in FIG. 1, may be adjusted to move the latch 12 horizontally to the left or right so that the point or location of triggering of the compact door closing latch mechanism may be adjusted.

Figure 5:
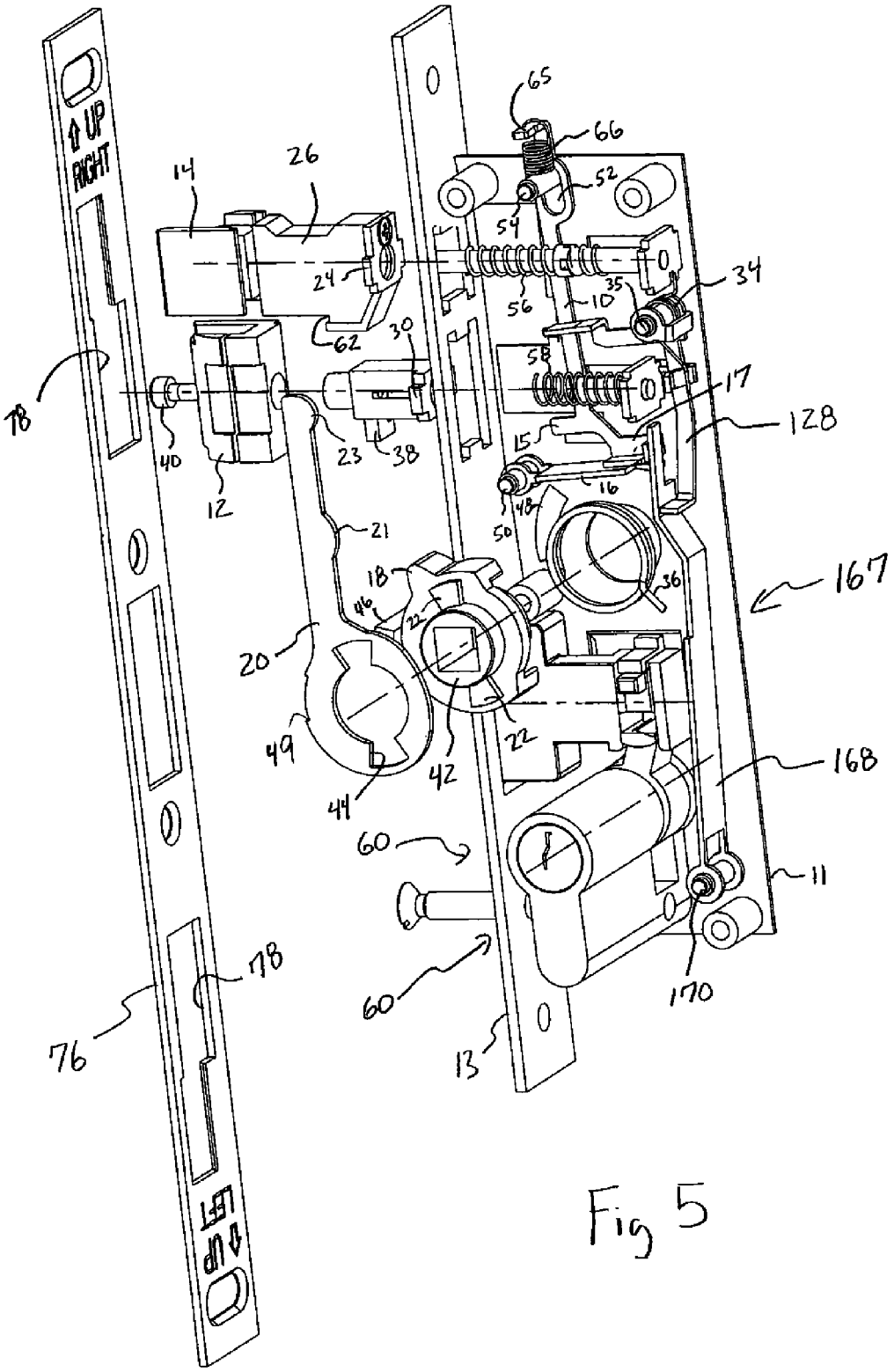
FIG. 5 is an exploded perspective view schematically illustrating the latching mechanism of another embodiment of the present invention having a trigger force amplifying mechanism.
Figure 6A:
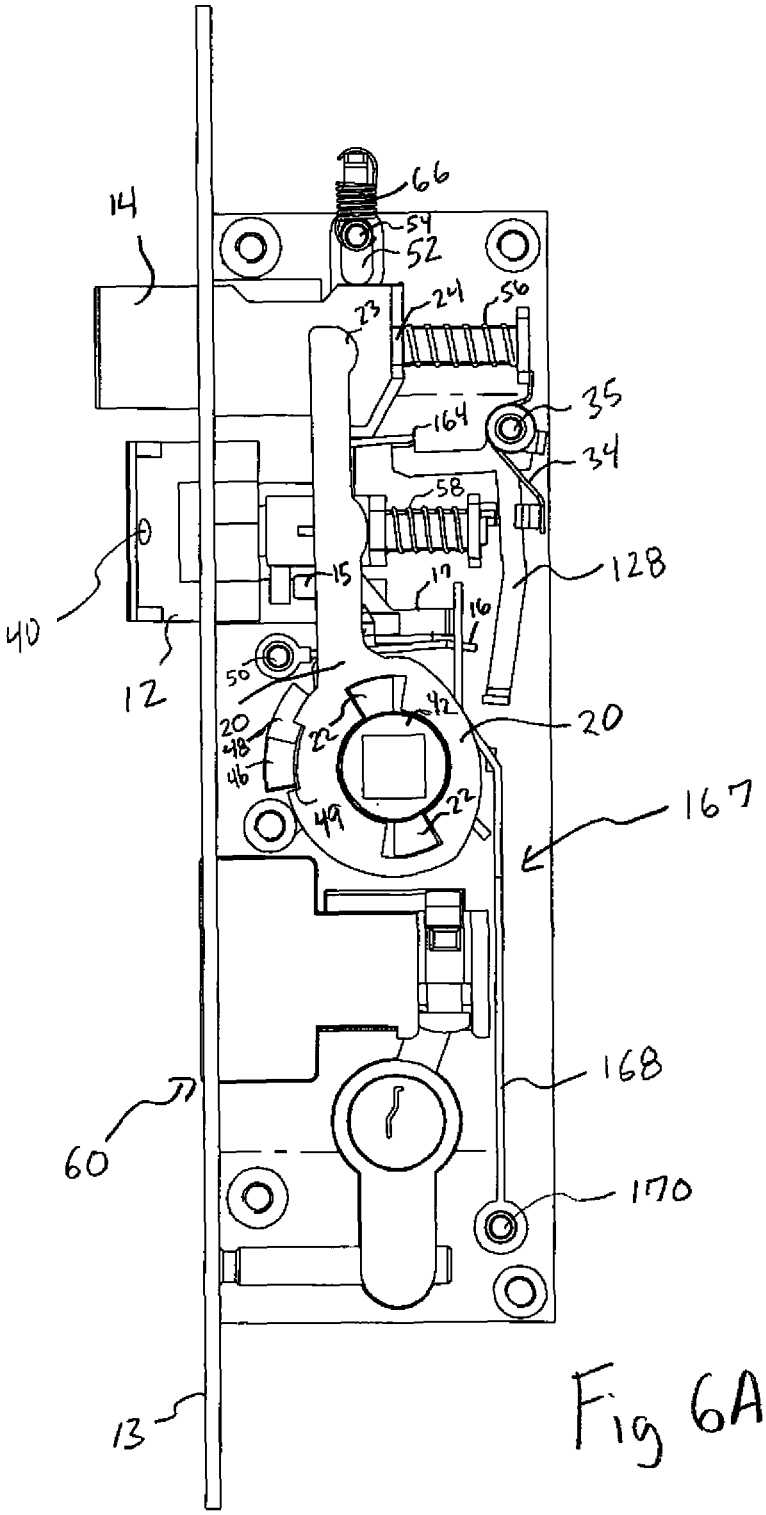
FIG. 6A-B are elevational views schematically illustrating the latching mechanism embodiment illustrated in FIG. 5 of the present invention in a sequence of operation.
Figure 6B:
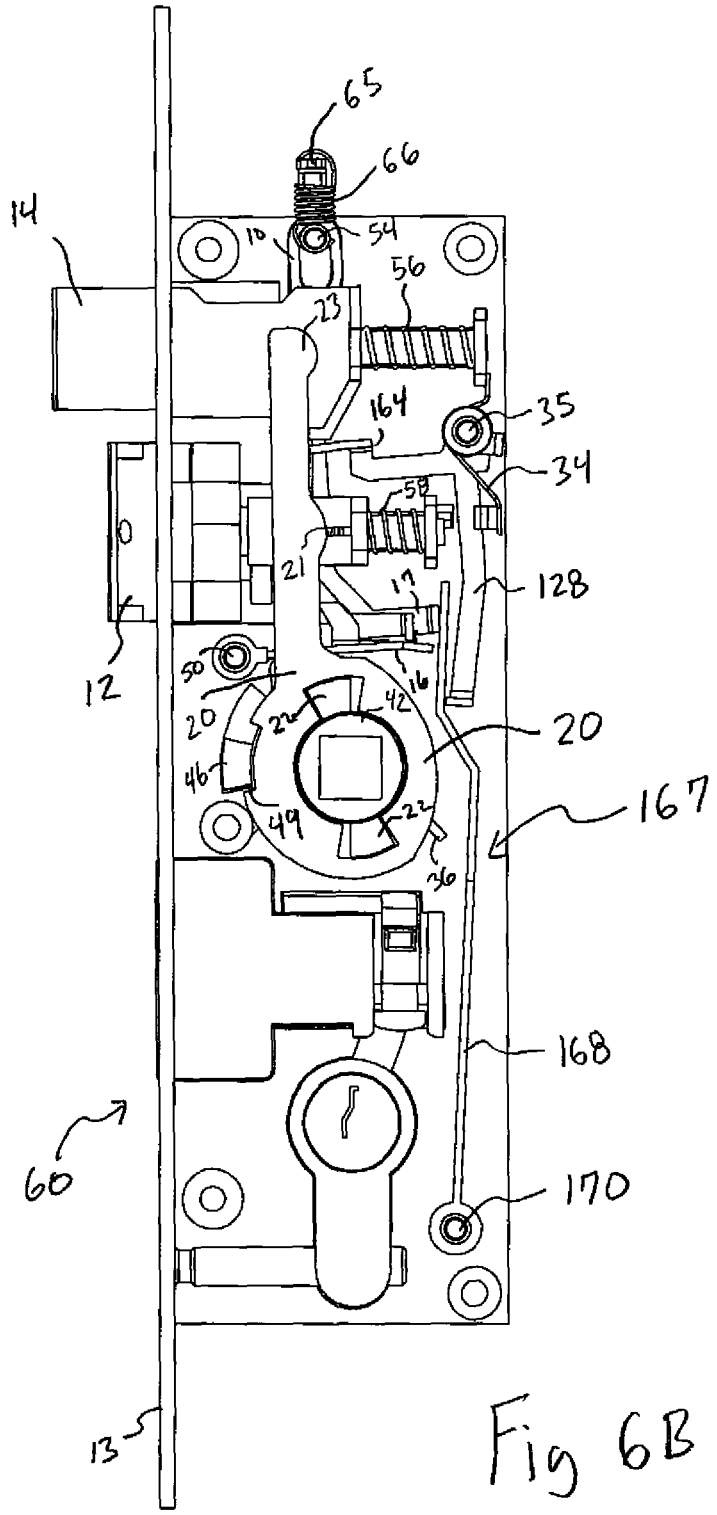

FIG. 5 and FIGS. 6A-6B illustrate another embodiment of the present invention having a trigger force amplifying mechanism 167 for adjusting the trigger force. In this embodiment, a force amplifying trigger lever 128 is used in combination with a force amplifying lever 168. The trigger force amplifying lever 168 is pivoted on force amplifying lever pivot 170. In this embodiment the force required to release the puller tongue 14 may be easily adjusted or selected. The force is selected by adjusting the point at which the force amplifying trigger lever 128 contacts the force amplifying lever 168. This creates an adjustable length moment arm resulting in the ability to make adjustments in the force required to release the puller tongue 14. FIG. 5 additionally illustrates a strike plate 76 that is held by a door jamb, not illustrated. The strike plate 76 has apertures or openings 78 into which the latch 12 and puller tongue 14 extend. An opening may also be provided for the dead bolt 60.

FIG. 6A illustrates door closing latching mechanism in a position ready to be set by the turning of a door knob, not illustrated, attached to door handle receiver 42.

FIG. 6B illustrates the latch 12 in a position so as to cause the trigger arm 17 to contact the force amplifying lever 168, releasing the puller tongue 14. The longer the distance between the point of contact of the trigger arm 17 with the force amplifying lever 168 and the point of contact of the force amplifying trigger lever 128 and the force amplifying lever 168, the less the triggering force will be due to the longer moment arm. To increase the triggering force this distance can be shortened, making a shorter moment arm. The operation of this embodiment is otherwise as indicated in FIGS. 1-4B.

Accordingly, the present invention provides a compact door closing latching mechanism that securely latches a door even though a door is initially closed softly or with little force. The present invention provides a puller tongue 14 that is triggered and released so as to pull or force the door closed, securely latching the door. The present invention is particularly advantageous when used in combination with a pneumatic door closer so that the pneumatic door closer may be adjusted so as to prevent a door from slamming and to close slowly and yet assure that the door is securely latched.

While the present invention has been described with respect to several different embodiments, it will be obvious that various modifications may be made without departing from the spirit and scope of this invention.

What is claimed is:

1. A door closing latching mechanism comprising:

a door handle receiver;

puller tongue means, within the door closing latching mechanism, for forcing an ajar door closed;

a latch;

a setting lever contacting said puller tongue means and latch when rotated;

means, coupled to said puller tongue means, for selectively holding said puller tongue means in a retracted position;

means, coupled to said latch, for selectively releasing said puller tongue means from the retracted position upon movement of said latch; and means, coupled to said door handle receiver, for decoupling said latch from said means for selectively releasing said puller tongue means from the retracted position when said door handle receiver is rotated, permitting said door handle receiver to be rotated without releasing said puller tongue means, whereby releasing of said puller tongue means is caused by movement of said latch when coupled to said means for selectively releasing said puller tongue means resulting in a door being pulled closed and latched securely.

2. A door closing latching mechanism as in claim 1 further comprising:

trigger adjusting means, coupled to said puller tongue means, for adjusting a point at which said puller tongue means is released from the retracted position.

3. A door closing latching mechanism as in claim 2 wherein:

said trigger adjusting means comprises a screw coupled to said latch, whereby said latch may be selectively moved by the screw.

4. A door closing latching mechanism as in claim 1 further comprising:

force amplifying means, coupled to said latch, for modifying the force required to release said puller tongue.

5. A door closing latching mechanism as in claim 4 wherein:

said force amplifying means comprises a force amplifying lever.

6. A door closing latching mechanism as in claim 1 further comprising:

a dead bolt.

7. A door closing latching mechanism as in claim 1 wherein:

said puller tongue means comprises a puller tongue angled surface positioned to contact an opening in a door jamb, wherein the puller tongue angled surface forces the ajar door closed when said puller tongue means is released from the retracted position.

8. A door closing latching mechanism as in claim 7 wherein:

said latch has a latch angled surface, the latch angled surface being angled in a direction opposite to the puller tongue angled surface.

9. A door closing latching mechanism for aiding in latching a closing door comprising:

a frame;

a puller tongue biased out of said frame and initially held in a retracted position within said frame;

a puller tongue angled surface formed on said puller tongue and positioned to contact an edge of an opening in a door jamb, whereby said puller tongue angled surface forces the closing door closed when released from the retracted position within said frame;

a latch biased out of said frame;

a latch angled surface formed on said latch, said latch angled surface being angled in a direction opposite to the direction of said puller tongue angled surface;

a door handle receiver attached to said frame;

a setting lever coupled to said door handle receiver and contacting said puller tongue and latch when rotated by said door handle receiver, whereby said puller tongue and said latch are forced into said frame;

a trigger lever coupled to said puller tongue, whereby said puller tongue may be selectively held within said frame in a retracted position;

a pendulum having an arc, said pendulum having a variable radius and a latch arm positioned to be selectively coupled to said latch and a trigger arm positioned to be selectively coupled to said trigger lever, said pendulum being capable of being selectively displaced along the variable radius of the arc, wherein when said pendulum is displaced along the variable radius said latch arm is decoupled from said latch permitting said latch to be moved without causing said pendulum to swing;

a raising lever coupled to said door handle receiver and said pendulum, whereby when said door handle receiver is rotated said raising lever moves said pendulum along the variable radius, whereby said latch is decoupled from said pendulum;

whereby when a door handle attached to said door handle receiver is rotated for opening a door said latch may be pushed into said frame without triggering release of said puller tongue when said pendulum is raised along the variable radius and when said latch contacts a strike plate on a door jamb when said pendulum is lowered along the variable radius so that the trigger arm is positioned to contact said trigger lever rotating said trigger lever when said latch moves triggering release of said puller tongue securely latching the door.

10. A door closing latching mechanism for aiding in latching a closing door as in claim 9 further comprising:

trigger adjusting means, coupled to said puller tongue, for adjusting a point at which said puller tongue is released from the retracted position.

11. A door closing latching mechanism for aiding in latching a closing door as in claim 10 wherein:

said trigger adjusting means comprises a screw coupled to said latch, whereby said latch may be moved by the screw.

12. A door closing latching mechanism for aiding in latching a closing door as in claim 9 further comprising:

a trigger force amplifying lever coupled to said pendulum and said trigger lever, whereby a force required to trigger release of said puller tongue may be selected.

13. A door closing latching mechanism for aiding in latching a closing door as in claim 9 further comprising:

a dead bolt within said frame.

14. A door closing latching mechanism for aiding in latching a closing door comprising:

a frame;

a puller tongue biased out of said frame and initially held in a retracted position within said frame;

a puller tongue angled surface formed on said puller tongue, wherein the puller tongue angled surface has a direction forcing an ajar door closed when said puller tongue is released and biased out of said frame contacting a puller tongue aperture in a strike plate on a door jamb;

a shoulder coupled to said puller tongue;

a trigger lever having a first arm engaging said shoulder, whereby said puller tongue can be selectively held in the retracted position within said frame;

a latch biased out of said frame;

a latch angled surface formed on said latch, said latch angled surface being angled in a direction opposite to the direction of said puller tongue angled surface;

a puller tongue contact coupled to said puller tongue;

a latch contact coupled to said latch;

a pendulum contact coupled to said latch;

a door handle receiver attached to said frame;

a cam placed on said door handle receiver positioned to selectively and directly contact a raising lever when said door handle receiver is rotated;

a setting lever rotatably coupled to said door handle receiver;

a distal end contact placed on said setting lever, wherein said distal end contact is positioned to contact said puller tongue contact when said setting lever is rotated, whereby said puller tongue is pushed into said frame and held in the retracted position;

an intermediate contact placed on said setting lever, wherein said intermediate contact is positioned to contact said latch contact when said setting lever is rotated, whereby said latch is pushed into said frame; and a pendulum having a latch arm positioned to selectively contact said pendulum contact and a trigger arm positioned to be selectively coupled to said trigger lever, said pendulum positioned to contact said raising lever, whereby said raising lever when moved by said cam displaces said pendulum and moves said latch arm out of alignment with said pendulum contact permitting said latch to be retracted into said frame, whereby when a door handle attached to said door handle receiver is rotated for opening a door said latch may be pushed into said frame without triggering release of said puller tongue when said pendulum is displaced and when said latch contacts the strike plate on the door jamb when said pendulum is placed so that the trigger arm is positioned to contact said trigger lever rotating said trigger lever when said latch moves triggering release of said puller tongue securely latching the door.

15. A door closing latching mechanism for aiding in latching a closing door as in claim 14 further comprising:

trigger adjusting means, coupled to said puller tongue, for adjusting a point at which said puller tongue is released from the retracted position.

16. A door closing latching mechanism for aiding in latching a closing door as in claim 15 wherein:

said trigger adjusting means comprises a screw coupled to said latch, whereby said latch may be moved by the screw.

17. A door closing latching mechanism for aiding in latching a closing door as in claim 14 further comprising:

a trigger force amplifying lever coupled to said pendulum and said trigger lever, whereby a force required to trigger release of said puller tongue may be selected.

18. A door closing latching mechanism for aiding in latching a closing door as in claim 14 further comprising:

a dead bolt within said frame.

19. A door closing latching mechanism for aiding in latching a closing door as in claim 14 further comprising:

the strike plate having a latch aperture therein, whereby the strike plate may be attached to the door jamb and said puller tongue and latch aligned so as to respectfully fit within the puller tongue and latch apertures in the strike plate.

* * * * *